US005082330A

United States Patent [19]

Holder

[11] Patent Number: 5,082,330

[45] Date of Patent: Jan. 21, 1992

[54] APPARATUS FOR REMOVING FLOOR COVERING

[75] Inventor: Tommie Holder, Snyder, Okla.

[73] Assignee: Cooper, Inc., Okla.

[21] Appl. No.: 638,284

[22] Filed: Jan. 7, 1991

[51] Int. Cl.[5] ..... B32B 31/18; F21C 47/00

[52] U.S. Cl. ..... 299/37; 15/93.1; 30/170

[58] Field of Search ..... 299/36, 37, 38, 39; 30/169, 170, 172; 15/93.1, 236.01; 51/176

[56] References Cited

U.S. PATENT DOCUMENTS 1,442,544 1/1923 Schwenke ..... 30/170

2,864,104 12/1958 Le Sage ..... 15/93.1

2,973,536 3/1961 Doyle ..... 15/93.1

3,007,687 11/1961 Hatcher ..... 299/39

4,848,845 7/1989 Kennedy ..... 299/39

*Primary Examiner*—David J. Bagnell

*Attorney, Agent, or Firm*—Dunlap, Codding, Peterson & Lee

[57] ABSTRACT

An apparatus for removing floor covering which has a frame supported by wheels. Some of the wheels are used to drive the frame and these wheels are powered by a structurally independent power source. A blade secured in front of th eframe may be used to push up floor covering.

12 Claims, 2 Drawing Sheets

APPARATUS FOR REMOVING FLOOR COVERING

FIELD OF THE INVENTION

The present invention relates generally to an apparatus for removing floor coverings.

SUMMARY OF THE INVENTION

The present invention comprises powerful, compact, and agile apparatus for removing floor covering. The apparatus comprises a frame with wheels for supporting and driving the frame. A blade secured in front of the frame may be used to push up floor covering.

DETAILED DESCRIPTION OF THE PREFERRED EMBODIMENT

Figures 1, 2:
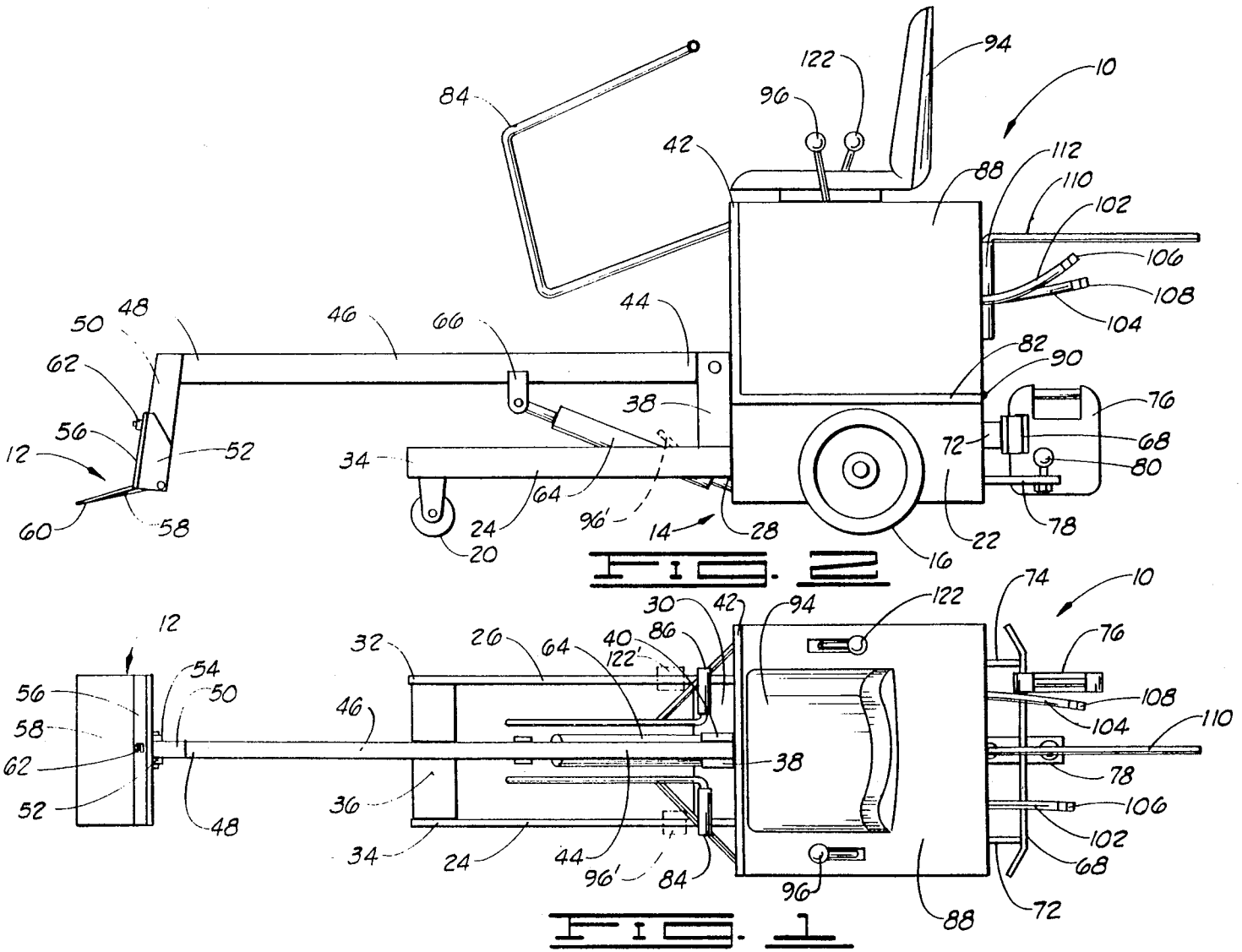
FIG. 1 is a plan view of apparatus constructed in accordance with the invention.
FIG. 2 is a side elevation of the apparatus of FIG. 1.
Figure 3:
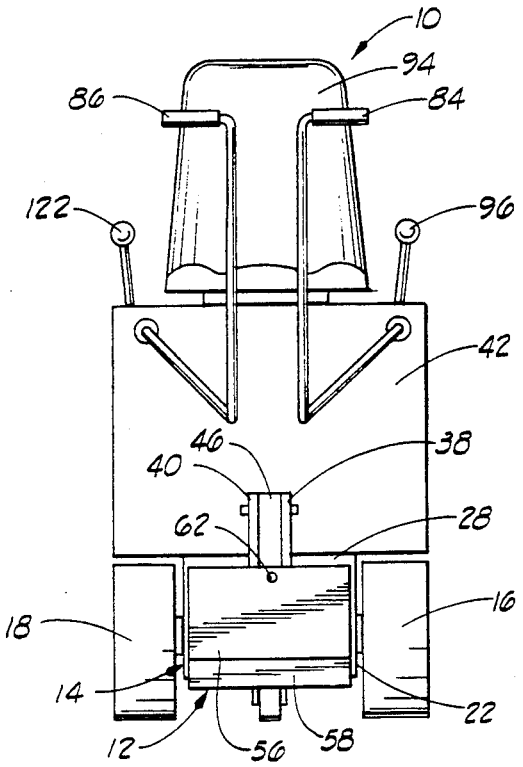
FIG. 3 is a front elevation of the apparatus of FIG. 1.
Figure 4:
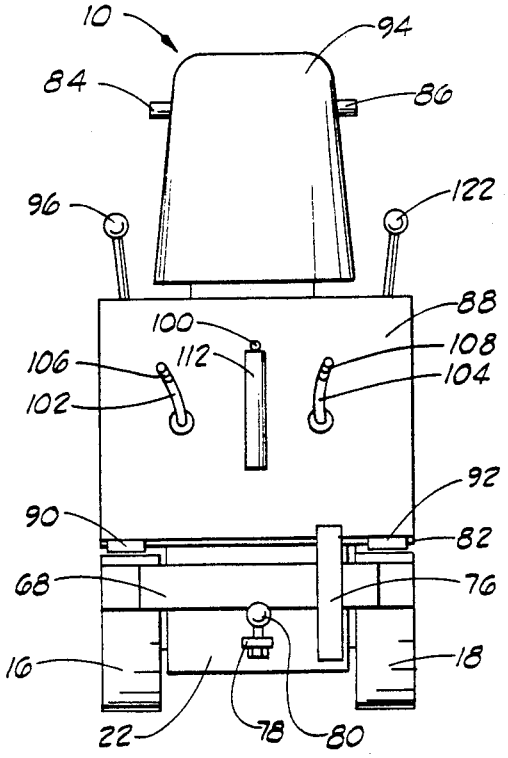
FIG. 4 is a rear elevation of the apparatus of FIG. 1.

Referring to the drawings in detail, reference number 10 generally designates a floor cover removing apparatus constructed in accordance with this invention. The apparatus 10 basically comprises a blade 12 secured in front of a frame 14 which is supported by wheels 16, 18 and 20.

The frame 14 has a rectangular base housing 22 with a pair of parallel beams 24 and 26 extending forwardly from the front side 28 thereof. A first brace 30 (FIG. 1) is secured to the rectangular base housing 22 and to each beam 24 and 26. Secured between ends 32 and 34 of the beams 24 and 26 is a second brace 36.

Drive wheels 16 and 18 are rotatably secured to opposite sides of the rectangular base housing 22. A caster wheel 20 is secured under the second brace 36 such that it will allow the frame to turn and move in any direction.

A pair of vertical parallel plates 38 and 40 are welded to the front side of the rectangular base housing 22, the first brace 30 and a front panel 42.

The first end 44 of a generally horizontal lift arm 46 is pivotally secured between the parallel plates 38 and 40. The second end 48 of the lift arm 46 extends forward past the ends, 32 and 34, of the beams 24 and 26. Secured to the second end 48 of the lift arm 46 and extending down therefrom is arm 50 adapted for pivotally mounting the blade 12.

The blade 12 is comprised of a pair of vertical parallel braces 52 and 54, a back plate 56 and a cutting plate 58. A flexible shear blade 60 (FIG. 2) may be secured to the cutting plate 58. It has been found that when removing tile it is preferable to secure the flexible shear blade 60 to the cutting plate 58. An anchor bolt 62 is secured through the back plate 56 and to the arm 50 to allow adjustment of the blade 12.

A lift cylinder 64 extends from the rectangular base housing 22 up to a bracket 66 welded to a midpoint on the lift arm 46. The lift cylinder 64 is adapted to raise and lower the lift arm 46.

Secured to the rear of the rectangular base housing 22 is a weight holder 68. The weight holder 68 is secured to the rectangular base housing 22 by a pair of mounts 72 and 74. The weight holder 68 is of sufficient size and strength to hold eight forty-two pound tractor type weights, such as weight 76. In addition to the rear weight holder 68, the beams 24 and 26 may also hold as many as five forty-two pound tractor weights each. Thus, one may add over 750 pounds of weight to the apparatus 10 thereby significantly increasing traction. In addition, a significant portion of this weight may be transferred to the blade 12 via the lift cylinder 64, thus preventing the blade 12 from riding over a floor covering.

An arm 78 has one end welded to the rear of the rectangular base housing 22 and a hole (not shown) cut in the opposite end to provide a location for attaching a trailer ball 80.

Secured above the rectangular base housing 22 is an upper base 82, and a front panel 42. Protruding through the front panel 42 are a pair of steering arms 84 and 86. Each steering arm controls the direction of rotation of a drive wheel.

An upper housing 88 is secured by hinges 90 and 92 to the rear of the upper base 82. On top of the upper housing 88 is an operator's seat 94.

Extending through the top of the upper housing 88 is a lift control lever 96. As is shown in FIGS. 1 and 2, the lift control lever 96 may be replaced with a foot pedal 96'.

Extending from the rear of the upper housing 88 are a pair of flexible conduits 102 and 104 with quick disconnects 106 and 108, and a pivotally mounted conduit holder 110.

The conduit holder 110 is an L-shaped rod pivotally secured in a hollow tubing 112. The hollow tubing 112 is secured, as by welding, to the upper housing 88 so that it extends vertically. The diameter of the conduit holder 110 is less than the diameter of the opening through the hollow tubing 112, thus, the conduit holder 110 can pivot from side to side. In this way, when the apparatus 10 is backed up, the conduit holder 110 will swing the conduits out of the way so they are not run over.

Figure 5:
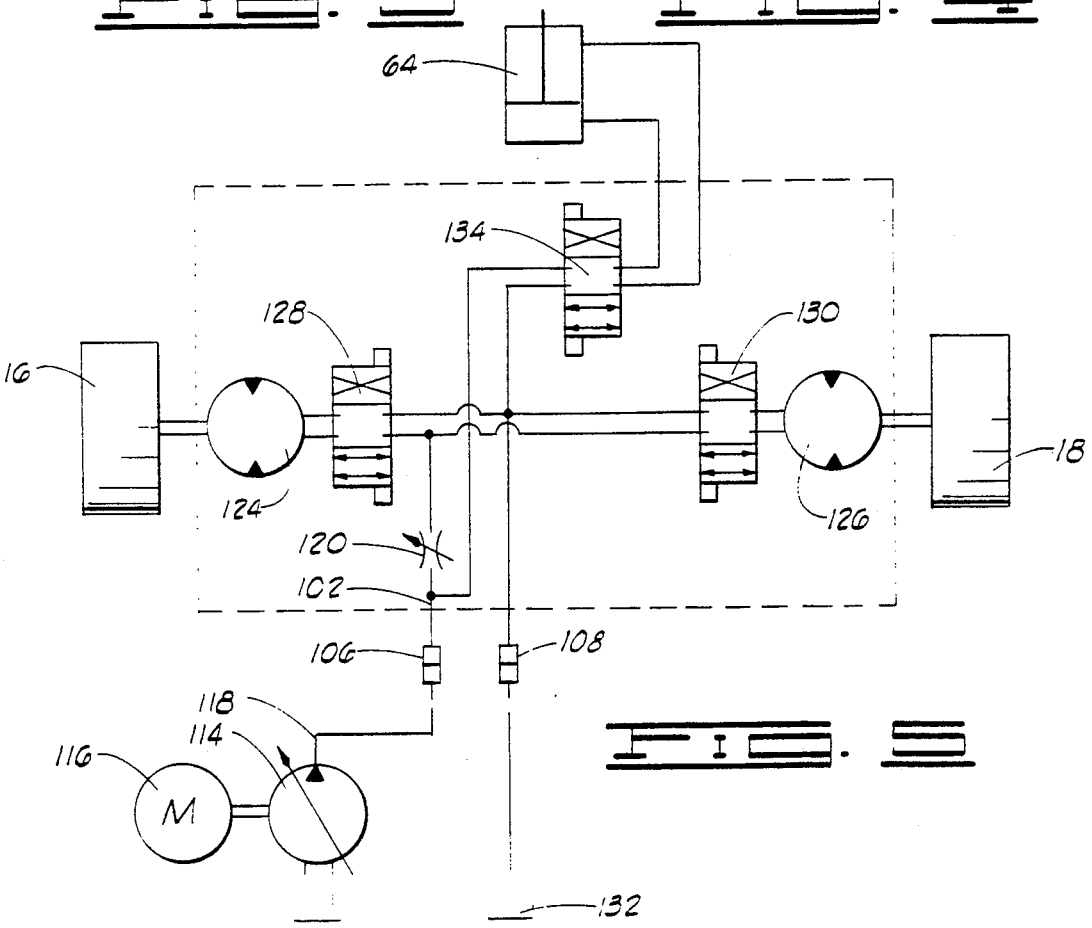
FIG. 5 is a schematic of the hydraulic system of the apparatus of FIG. 1.

As is shown in FIG. 5, the apparatus 10 is powered by a structurally independent pump 114. In this way, a large motor 116, such as one which produces 25 HP or more may be used to power the apparatus 10. By utilizing an external power source the apparatus 10 may still be built small enough to easily maneuver through a building. The overall width of the apparatus 10 should be less than the door width, preferably less than two feet, so that interior doorways are not a barrier.

Fluid flowing from the independent pump 114 passes through external conduit 118, through the quick disconnect 106 and through conduit 102. From conduit 102 the fluid traverses the variable restricting valve 120. The variable restricting valve 120 is connected to a control lever 122 or to a foot pedal 122' (FIG. 1). The variable restricting valve 120 determines the amount of fluid which may flow to motors 124 and/or 126 thereby dictating the speed of the apparatus 10.

The fluid then passes through valve 128 and/or valve 130, through the motor 124 and/or 126, and back to supply reservoir 132. Valves 128 and 130 are controlled by steering arms 84 and 86 respectively (FIGS. 1–4). It should be noted that by moving one control lever one direction and the other control lever the opposite direction, the apparatus 10 may be made to turn about a point, thus further increasing the ability of apparatus 10 to work in close quarters.

The lift cylinder 64 is controlled by valve 134. The valve 134 is connected to lift control lever 96.

Changes may be made in the combinations, operations and arrangements of the various parts and elements described herein without departing form the spirit and scope of the invention as defined in the following claims.

What is claimed is;

1. An apparatus for removing floor covering comprising:

a frame;

a plurality of wheels secured to the frame for supporting and driving the frame, wherein at least one of the wheels is a caster wheel;

a blade secured to the frame;

means for raising and lowering the blade, wherein the blade raising and lowering means comprising:

an arm with a first and a second end, wherein the first end is pivotally secured to the frame and the second end is secured to the blade; and a cylinder secured to the arm and to the frame;

at least two motors secured to the frame wherein each motor drives a wheel;

means for steering the apparatus;

a pump structurally independent from the frame for creating a flow of fluid; and a plurality of conduits connected to the pump and to the motors for carrying the flow of fluid from the pump to the motors.

2. The apparatus of claim 1 wherein the means for steering comprises a means for regulating the flow of fluid to at least one motor.

3. The apparatus of claim 1 wherein the blade is pivotally secured to the arm.

4. An apparatus for removing floor covering comprising:

a frame, wherein the frame has a length and a width, and wherein the width is less than about two feet;

a plurality of wheels secured to the frame for supporting and driving the frame, wherein at least one of the wheels is a caster wheel;

a blade secured to the frame;

means for raising and lowering the blade, wherein the raising and lowering means comprises:

an arm with a first and a second end, wherein the first end is pivotally secured to the frame and the second end is secured to the blade; and a cylinder secured to the arm and to the frame;

at least two motors secured to the frame wherein each motor drives a wheel;

a pump structurally independent from the frame for creating a flow of fluid;

a plurality of conduits connected to the pump and to the motors for carrying the flow of fluid from the pump to the motors; and means for regulating the flow of fluid.

5. The system for removing a floor covering comprising:

a frame;

a pump structurally independent from the frame for creating a flow of fluid; and a plurality of conduits connected to the frame and to the pump;

means secured to the frame for supporting and driving the frame;

a blade secured to the frame; and means secured to the frame for raising and lowering the blade.

6. The apparatus of claim 5 wherein the blade raising and lowering means comprises:

an arm with a first end and a second end, wherein the first end is secured to the frame and the second end is secured to the blade; and a cylinder secured to the arm and to the frame.

7. The apparatus of claim 5 wherein the supporting and driving means comprises:

a plurality of wheels;

at least two motors wherein each motor drives a wheel; and means for steering the apparatus.

8. The apparatus of claim 7 wherein the means for steering comprises a means for regulating the flow of fluid to at least one motor.

9. The apparatus of claim 7 wherein at least one wheel is a caster wheel.

10. The apparatus of claim 5 wherein the frame has a length and a width, and wherein the width is less than about two feet.

11. The apparatus of claim 5 further comprising a shear blade secured to the blade.

12. The apparatus of claim 5 wherein the blade is pivotally secured to the frame.

* * * * *